US011143997B2

(12) United States Patent
Toyofuku

(10) Patent No.: US 11,143,997 B2
(45) Date of Patent: Oct. 12, 2021

(54) IMAGE FORMING APPARATUS

(71) Applicant: KONICA MINOLTA, INC., Tokyo (JP)

(72) Inventor: Katsuya Toyofuku, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/004,214

(22) Filed: Aug. 27, 2020

(65) Prior Publication Data

US 2021/0063936 A1 Mar. 4, 2021

(30) Foreign Application Priority Data

Aug. 29, 2019 (JP) ..... JP2019-156257

(51) Int. Cl.
*G03G 15/00* (2006.01)

(52) U.S. Cl.
CPC ..... *G03G 15/5054* (2013.01); *G03G 15/5062* (2013.01); *G03G 2215/00063* (2013.01); *G03G 2215/0164* (2013.01)

(58) Field of Classification Search
CPC ..... G03G 15/162; G03G 15/1605; G03G 15/5054; G03G 15/5058; G03G 2215/00029; G03G 2215/00059; G03G 2215/00063; G03G 2215/0164
See application file for complete search history.

(56) References Cited

U.S. PATENT DOCUMENTS

2010/0226668 A1* 9/2010 Swift ..... G03G 15/162 399/49

FOREIGN PATENT DOCUMENTS

JP 2012123294 A 6/2012

* cited by examiner

*Primary Examiner* — Thomas S Giampaolo, II
(74) *Attorney, Agent, or Firm* — Cantor Colburn LLP

(57) ABSTRACT

An image forming apparatus including a belt, a plurality of color information detectors, and a hardware processor. The belt is a belt on which images of a plurality of colors are formed to be laid on each other by a plurality of image formers that form the images of color components different from each other, the belt being colorless and transparent and having a transparency. The plurality of color information detectors are arranged on a front surface side and a back surface side of the belt, and detect, from the front and back surface sides, color information about a pattern image including two layers formed on the belt by two image formers among the plurality of image formers. The hardware processor calculates a color correction amount of an image formed by the two image formers based on detection results by the color information detectors.

9 Claims, 5 Drawing Sheets

IMAGE FORMING APPARATUS

CROSS-REFERENCE TO RELATED APPLICATIONS

The present application claims priority under 35 U.S.C. § 119 to Japanese Patent Application No. 2019-156257 filed on Aug. 29, 2019, the entire content of which is incorporated herein by reference.

BACKGROUND

Technological Field

The present invention relates to an image forming apparatus.

Description of the Related Art

There has been conventionally known a technique of measuring, with a sensor, a secondary color pattern which was formed on a sheet and fixed and correcting image data on the basis of the measurement results as a means for suppressing a color variation in the secondary color in an image forming apparatus.

JP 2012-123294 A describes, for color correction of multicolor, transferring multicolor toner patches onto the belt to be laid on each other and fixing and mixing the colors of the patches with a transfer fixing device, and correcting an image control parameter on the basis of the detection results obtained by detecting, with a sensor, color information about the patches after the fixing and mixing of the colors. JP 2012-123294 A also describes making the brightness of the toner image forming surface of the belt higher than the brightness of the toner in order to improve the toner detection performance.

SUMMARY

However, the method of measuring a pattern formed on a sheet with a sensor has problems that are waste of sheets and reduction of productivity due to the method being performed in a mode which is dedicated for the correction. Moreover, since the measurement is performed to the image after fixation, the toner after mixing of two layers of colors is measured, and it is difficult to grasp the adhering amount of a single color for optimum correction. Similarly, the technique described in JP 2012-123294 A also measures the toner after the two layers of colors are mixed after fixation, and thus it is difficult to grasp the adhering amount of a single color for optimum correction.

An object of the present invention is to accurately detect color information on each color forming the secondary color and enable effective correction of the secondary color in an image forming apparatus.

To achieve at least one of the abovementioned objects, according to an aspect of the present invention, an image forming apparatus reflecting one aspect of the present invention is an image forming apparatus including: a belt on which images of a plurality of colors are formed to be laid on each other by a plurality of image formers that form the images of color components different from each other, the belt being colorless and transparent and having a transparency; a plurality of color information detectors that are arranged on a front surface side and a back surface side of the belt, and detect, from the front surface side and the back surface side, color information about a pattern image including two layers formed on the belt by two image formers among the plurality of image formers; and a hardware processor that calculates a color correction amount of an image formed by the two image formers based on detection results by the color information detectors.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments or the illustrated examples.

(Configuration of Image Forming Apparatus 1)

Figure 1:
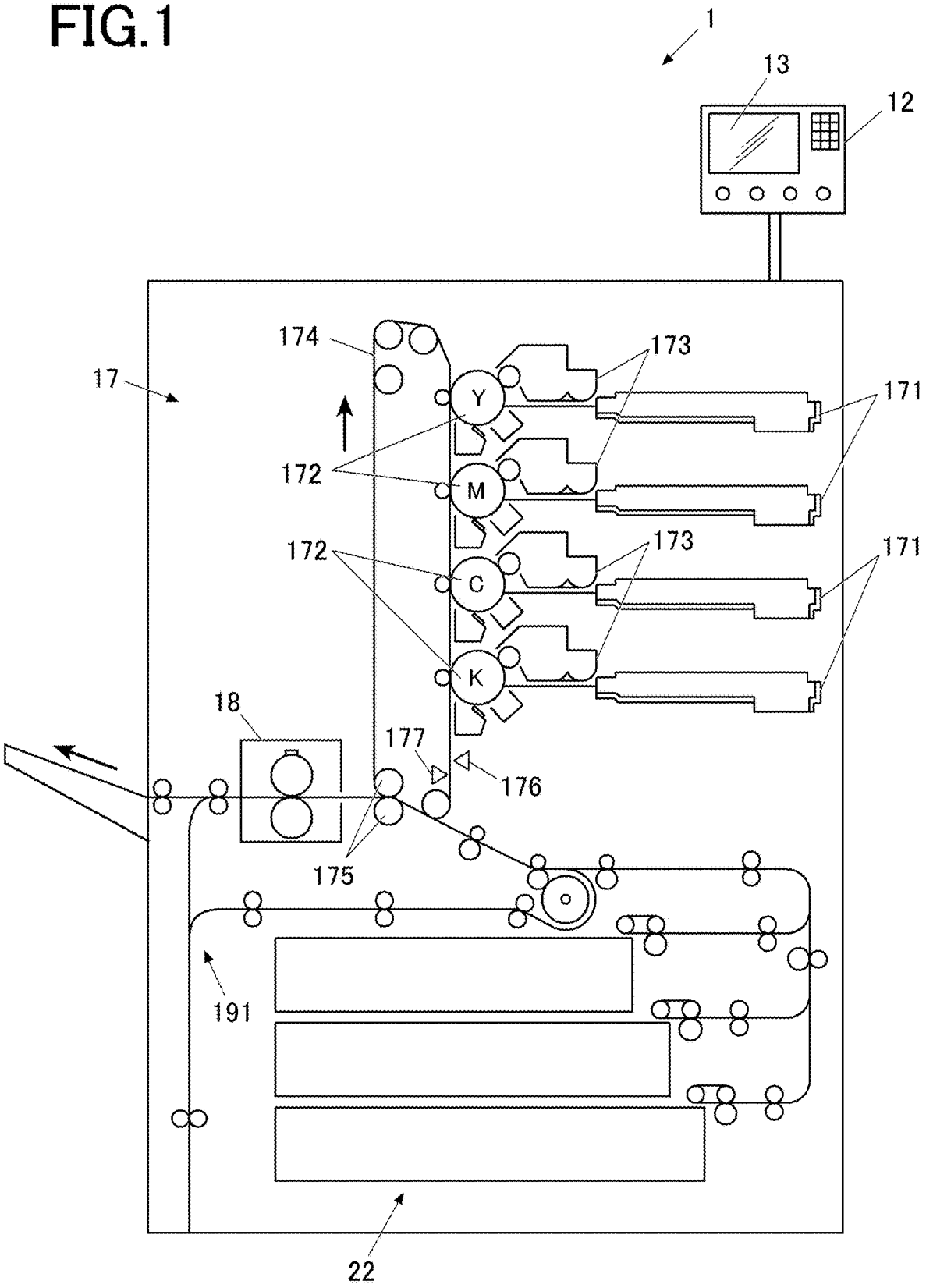
FIG. 1 is a view showing a schematic configuration example of an image forming apparatus in an embodiment of the present invention.
Figure 2:
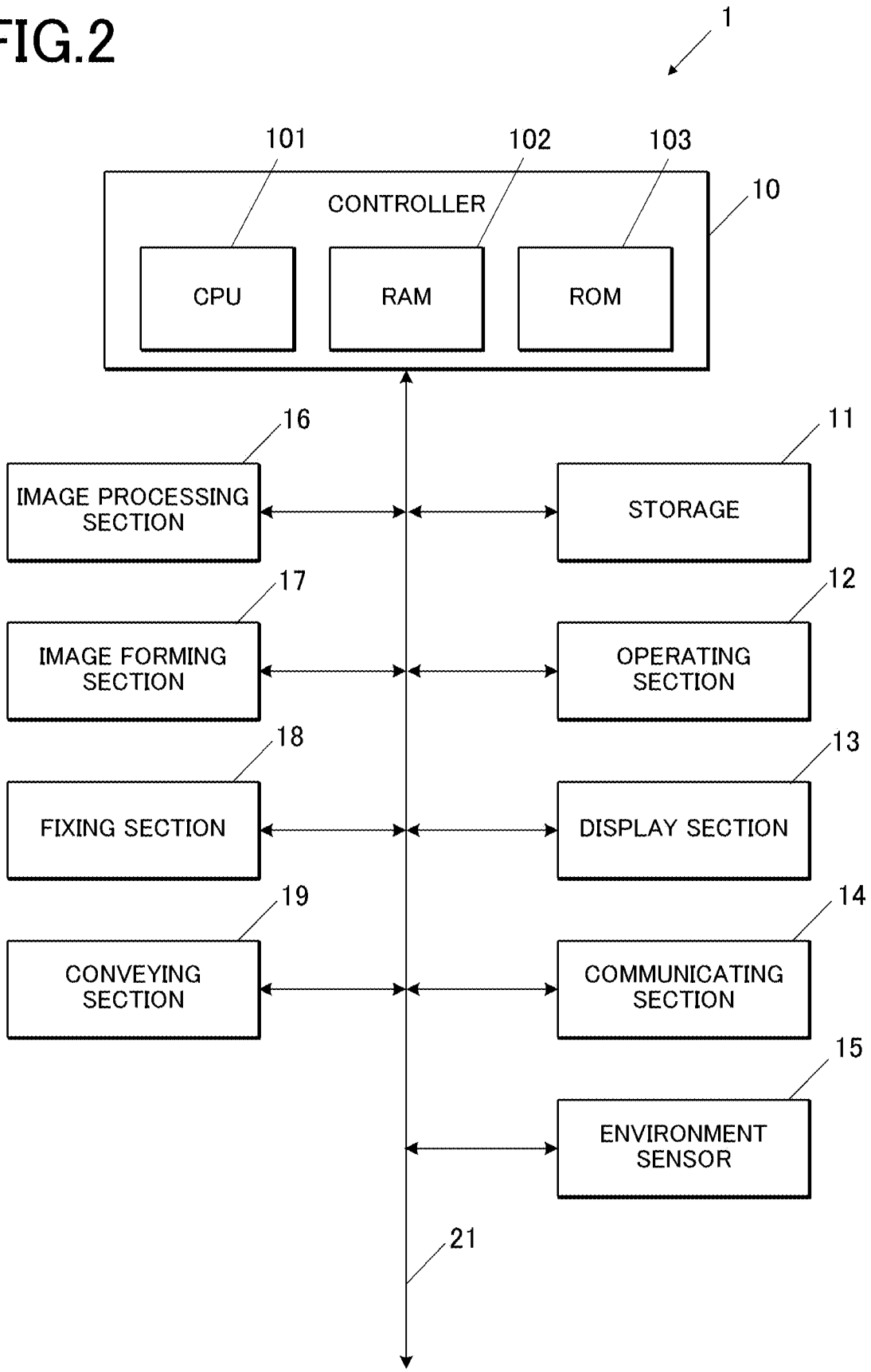
FIG. 2 is a block diagram showing the functional configuration of the image forming apparatus in FIG. 1.

FIG. 1 is a view showing a schematic configuration of an image forming apparatus 1 according to an embodiment of the present invention. FIG. 2 is a block diagram showing the main functional configuration of the image forming apparatus 1.

The image forming apparatus 1 includes a controller 10 (hardware processor) that includes a CPU 101 (Central Processing Unit), a RAM 102 (Random Access Memory), and a ROM 103 (Read Only Memory), a storage 11, an operating section 12, a display section 13, a communicating section 14, an environment sensor 15, an image processing section 16, an image forming section 17, a fixing section 18, a conveying section 19 and the like. The controller 10 is connected to the storage 11, the operating section 12, the display section 13, the communicating section 14, the environment sensor 15, the image processing section 16, the image forming section 17, the fixing section 18 and the conveying section 19 via a bus 21.

The CPU 101 reads out and executes a program stored in the ROM 103 or the storage 11, and performs various types of arithmetic processing.

The RAM 102 provides a memory space for working to the CPU 101 and stores temporary data.

The ROM 103 stores various types of programs and setting data and the like performed by the CPU 101. Instead of the ROM 103, a rewritable nonvolatile memory such as an EEPROM (Electrically Erasable Programmable Read Only Memory) and a flash memory may be used.

The controller 10 including these CPU 101, RAM 102 and ROM 103 integrally controls the components of the image forming apparatus 1 in accordance with the above-mentioned various programs. For example, when a job is input, the controller 10 controls each component on the basis of the input job, to form an image on a sheet on the basis of the image data of the job. While the job is performed, the controller 10 counts the number of printed sheets, operation time, and operation distance (print distance). When each of the count values becomes a predetermined threshold or more, the controller 10 restarts the counting by resetting the count value that reached the threshold. While a job related to image data of secondary color is performed, the controller 10 executes after-mentioned color correction processing (see FIG. 5), and achieves the functions as a correction amount calculator, a controller and a corrector.

The storage 11 is configured by including a DRAM (Dynamic Random Access Memory) and the like. The storage 11 stores the job (setting information on the job and image data) and the like which were input from an external PC (Personal Computer) or the like via the communicating section 14. These pieces of image data or the like may be stored in the RAM 102.

The operating section 12 outputs various types of information set by the user to the CPU 101 of the controller 10. As the operating section 12, for example, there can be used a touch panel which enables input operation in accordance with the information displayed on the display.

The display section 13 includes a display device such as an LCD (Liquid crystal display), and displays an operation screen and the like showing the state of image forming apparatus 1 and the contents of the input operation to the touch panel.

The communicating section 14 is configured by including a communication control card such as a LAN (Local Area Network), for example, and performs transmission/reception of various types of data with an external device (for example, PC) connected to a communication network such as a LAN and a WAN (Wide Area Network).

The environment sensor 15 measures the environment (for example, temperature, humidity or the like) inside the image forming apparatus 1 and outputs the measurement value to the controller 10.

The image processing section 16 includes a rasterizing processing section, a color converting section, a tone correcting section and a halftone processing section, for example, and performs various types of image processing to image data (image data of four color components that are Y (yellow), M (magenta), C (cyan) and K (black)) of the job stored in the storage 11 and stores the processed image data in the storage 11.

The image forming section 17 forms an image on a sheet on the basis of the image data of the job stored in the storage 11. The image forming section 17 includes four sets of image formers (exposing sections 171, photoreceptors 172 and developing sections 173) corresponding to the respective four color components of Y, M, C and K.

The exposing section 171 includes an LD (Laser Diode) as a light emitting element. The exposing section 171 drives the LD on the basis of the image data and emits the laser light onto the charged photoreceptor 172 for exposure, and forms an electrostatic latent image on the photoreceptor 172. Each of the developing sections 173 supplies toner of a predetermined color (one of Y, M. C and K) to the exposed photoreceptor 172 with a developing roller, and develops the electrostatic latent image formed on the photoreceptor 172.

The images (single color images) formed with the toner of Y, M. C and K on the respective four photoreceptors 172 corresponding to Y, M, C and K are sequentially overlaid and transferred onto the intermediate transfer body 174 as an image carrier from the respective photoreceptors 172. Thus, a color image having toner layers of Y, M, C and K superposed on the intermediate transfer body 174 is formed.

The intermediate transfer body 174 is an endless belt (belt) that is wound by a plurality of transfer body conveyance rollers, and rotates in the arrow direction of FIG. 1 in accordance with the rotation of each of the transfer body conveyance rollers. In the present embodiment, the intermediate transfer body 174 is formed of a material which is plain and colorless and has a transparency (that is, material which is plain and colorless, and transparent or semitransparent).

Two color information detectors 176 and 177 are provided, with the intermediate transfer body 174 therebetween, in a place that is on the downstream side of the image formers and on the upstream side of the secondary transfer rollers 175. Each of the color information detectors 176 and 177 is formed by a color sensor including LED (Light Emitting Diode) of R (red), G (green) and B (blue), lens, light receiving elements and the like. Each of the color information detectors 176 and 177 emits light from the LED to a pattern image 30 for correction of the secondary color which was formed on the intermediate transfer body 174, detects the color information by the reflected amount of the light and outputs the detection result to the controller 10.

Figure 3:
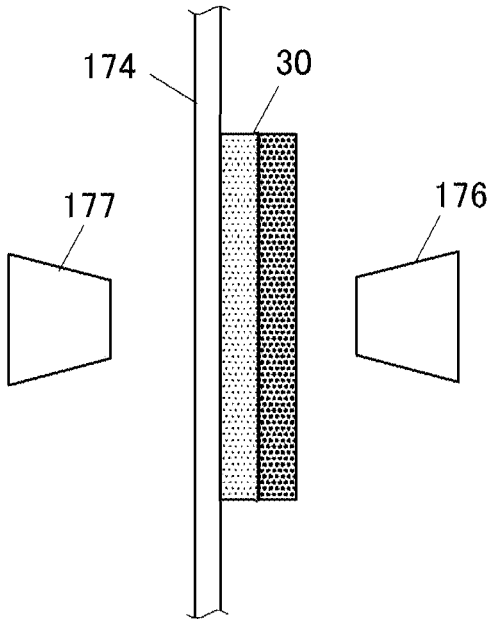
FIG. 3 is a view showing an example of a positional relationship between two color information detectors and an intermediate transfer body.

FIG. 3 is a view showing the positional relationship between the color information detectors 176 and 177 and the intermediate transfer body 174.

As shown in FIG. 3, the color information detector 176 is provided to face the front surface of the intermediate transfer body 174 on which the toner is formed. When a job starts or during printing, the color information detector 176 detects the color information about the surface of the pattern image 30 on the color information detector 176 side, the pattern image 30 including two layers of toner images formed to be laid on each other on the intermediate transferring boy 174 by the two image formers of the image forming section 17. The color information detector 177 is provided to face the back surface of the intermediate transfer body 174 on which the toner is not formed, and the color information detector 177 detects the color information about the surface of the above-mentioned pattern image 30 on the color information detector 177 side when a job starts or during printing. Since the intermediate transfer body 174 is made of a material that is plain and colorless, and has a transparency, it is possible to detect the color of the image of the lower layer in the pattern image 30 with the color information detector 177 which is set on the back surface side of the intermediate transfer body 174.

Figure 4:
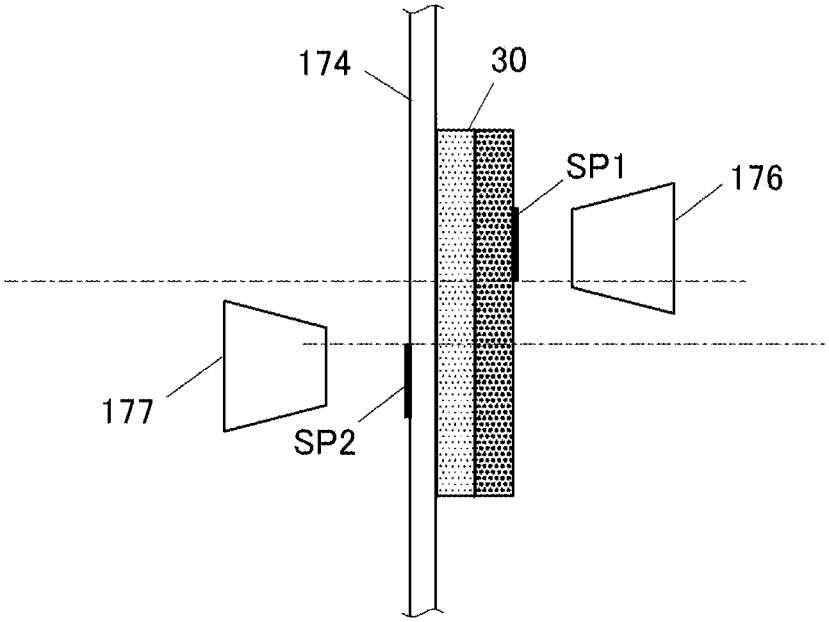
FIG. 4 is a view showing another example of the positional relationship between the two color information detectors and the intermediate transfer body.

When the color information detectors 176 and 177 face each other with the intermediate transfer body 174 therebetween, each of the color information detectors 176 and 177 may not correctly detect the color information due to the influence by the emitted light from the color information detector on the opposite side. Thus, as shown in FIG. 4, it is preferable that the color information detectors 176 and 177 are arranged such that the spot face SP1 of light emitted from the color information detector 176 and the spot face SP2 of light emitted from the color information detector 177 do not overlap with each other. Though the positions of the color information detector 176 and the color information detector 177 are shifted in the rotation direction of the intermediate transfer body 174 in FIG. 4, the positions may be shifted in the axis direction orthogonal to the rotation direction, and the direction to shift the positions is not particularly limited.

The secondary transfer rollers 175 transfers the color image on the intermediate transfer body 174 onto the sheet which was fed from a sheet feeding tray 22. In detail, by a predetermined transfer voltage being applied to the secondary transfer rollers 175 nipping the sheet and the intermediate transfer belt 174, the toner forming the color image on the intermediate transfer body 174 is drawn toward the sheet side and transferred to the sheet. Thus, the image is formed on the sheet.

The fixing section 18 performs fixing processing of fixing the toner to the sheet by heating and pressurizing the sheet on which the image is transferred.

The conveying section 19 includes a plurality of sheet conveyance rollers that convey a sheet by rotating while nipping the sheet, and the conveying section 19 feeds the sheet from the sheet feeding tray 22 and conveys the sheet via a predetermined conveyance path. The conveying section 19 includes a reversing mechanism 191 that reverses the sheet to which the fixing processing was performed by the fixing section 18, and conveys the sheet to the secondary transfer rollers 175. In the image forming apparatus 1, when image forming is performed on both sides of the sheet, the sheet is reversed by the reversing mechanism 191 to form the image on both sides and thereafter the sheet is conveyed to a sheet ejection tray. When an image is formed on only one side of the sheet, the sheet having the image formed on the one side is conveyed to the sheet ejection tray without the reversing of the sheet by the reversing mechanism 191.

(Operation of Image Forming Apparatus 1)

Figure 5:
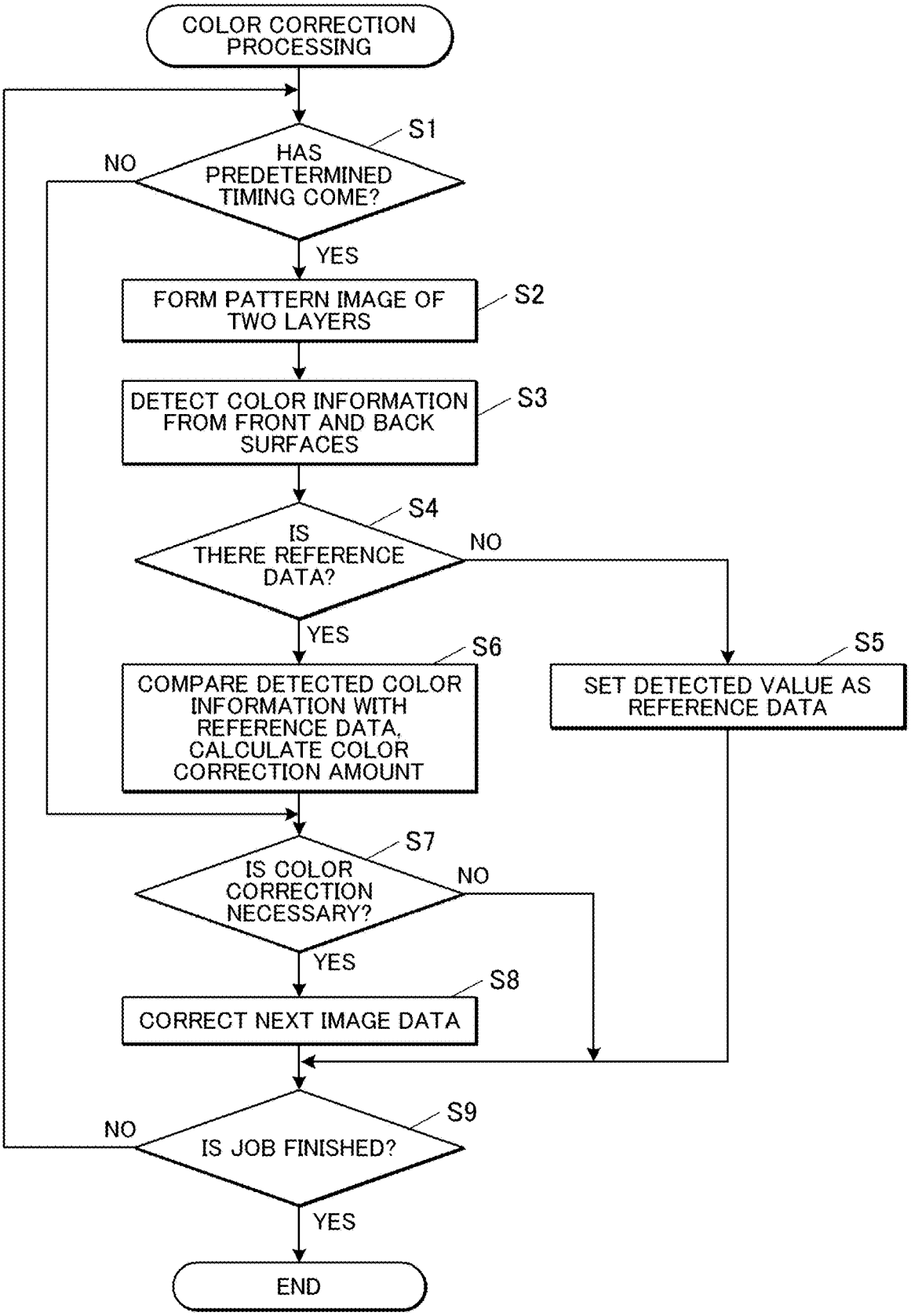
FIG. 5 is a flowchart showing color correction processing executed by a controller in FIG. 2.

Hereinafter, with reference to FIG. 5, color correction processing executed by the image forming apparatus 1 will be described. The color correction processing is performed by cooperation between the controller 10 and the program stored in the storage 11 when the job of secondary color is started.

First, the controller 10 determines whether or not a predetermined timing has come (step S1).

The predetermined timing is, for example, a job start timing (reference timing), a timing when the number of printed sheets reaches a predetermined number or more, a timing when the operation time of the image forming apparatus 1 reaches a predetermined time or more, a timing when the operation distance (print distance) of the image forming apparatus 1 reaches a predetermined distance or more, or a timing when the environment change amount (for example, change amount from the job start of the measurement value of the environment sensor 15) reaches a predetermined threshold or more.

If the controller 10 determines that the predetermined timing has come (step S1; YES), the controller 10 controls the image forming section 17 to form a pattern image 30 for correction of a secondary color which includes two layers of toner images laid on each other, by controlling the image formers of two different colors corresponding to the image data (secondary color) of the job to sequentially form the images on the intermediate transfer body 174 (step S2). For example, the controller 10 controls the image forming section 17 to form a pattern image 30 including images of Y and M, M and C or Y and C laid on each other on the intermediate transfer body 174.

Next, the controller 10 controls the color information detectors 176 and 177 to detect the color information on the two colors forming the pattern image 30 formed on the intermediate transfer body 174 (step S3).

In the present embodiment, the colors are laid on the intermediate transfer body 174 in the order of the image creating process. For example, when the image creating process order is Y, M, C and then K as shown in FIG. 1, the toner images are laid in the order of Y, M, C and K from the bottom on the intermediate transfer body 174. Thus, the color information detector 176 located on the front surface side of the intermediate transfer body 174 detects the color information on the color for which the image was formed on the downstream side of the image creating process among the two colors forming the pattern image 30. The color information detector 177 located on the back surface side of the intermediate transfer body 174 detects the color information on the color for which the image was formed on the upstream side of the image creating process. For example, when the pattern image 30 is formed of two layers of Y and M, the color information detector 176 detects the color information on M and the color information detector 177 detects the color information on Y. When the pattern image 30 is formed of two layers of M and C, the color information detector 176 detects the color information on C and the color information detector 177 detects the color information on M. When the pattern image 30 is formed of two layers of Y and C, the color information detector 176 detects the color information on C and the color information detector 177 detects the color information on Y.

The controller 10 determines whether or not the reference data is stored in the storage 11 (step S4).

The reference data is data indicating a reference of color information on the two colors forming the pattern image 30.

If the controller 10 determines that the reference data is not stored in the storage 11 (step S4; NO), the controller 10 stores the detected values in step S3 in the storage 11 as the reference data (step S5), and proceeds to step S9.

If the controller 10 determines that the reference data is stored in the storage 11 (step S4; YES), the controller 10 compares the reference data with the color information detected in step S3, and calculates the color correction amount on the basis of the comparison result (step S6).

Figure 6A:
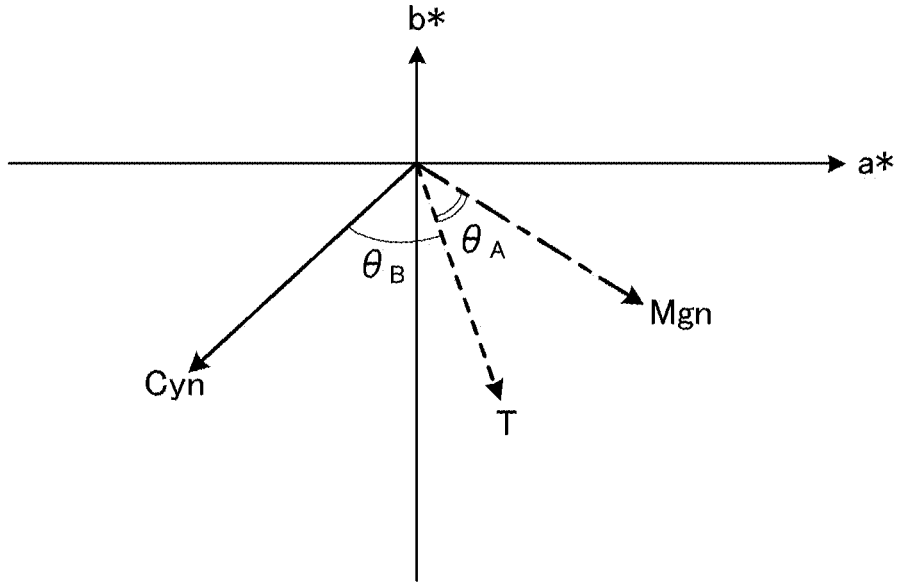
FIG. 6A is a view for explaining a difference ratio of differences between color information on respective two colors in reference data and a target color.
Figure 6B:
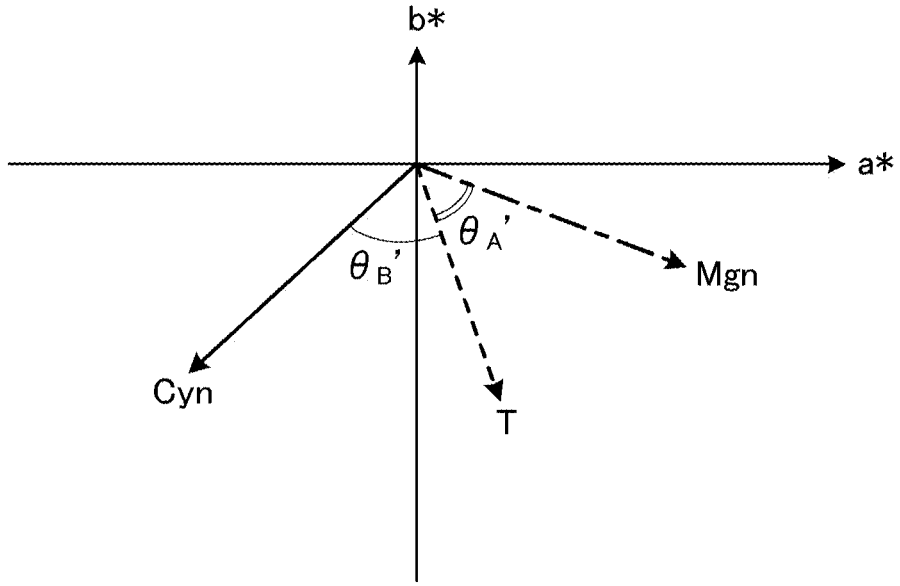
FIG. 6B is a view for explaining a difference ratio of differences between color information on respective two colors in detection results by the color information detectors and the target color.

The comparison and calculation methods of the color correction amount in step S6 will be described with reference to FIGS. 6A and 6B. FIGS. 6A and 6B are illustrations for a pattern image 30 which is formed of two layers of M and C.

First, the controller 10 converts the color information (RGB values) of the two colors of the reference data into L*a*b*, and plots them on a coordinate space with a* and b* as the axis (points of Mgn and Cyn in FIG. 6A). Next, the controller 10 calculates an angle $\theta_A$ made by the points plotting a target color T which is determined in advance and the points plotting one of the colors of the reference data, and an angle $\theta_B$ made by the points plotting the target color T and the points plotting the other color of the reference data. The controller 10 then calculates the difference ratio $\theta_B/\theta_A$ which is the ratio of the differences between respective colors and the target color T (hue differences). The difference ratio $\theta_B/\theta_A$ of the reference data which was once calculated may be stored in the storage 11 and the difference ratio $\theta_B/\theta_A$ stored in the storage 11 may be used at the time of the next calculation of color correction amount.

Similarly, the controller 10 converts the color information (RGB values) of the two colors detected in step S3 into L*a*b*, and plots them on a coordinate space with a*and b* as the axis (points of Mgn and Cyn in FIG. 6B). Next, the controller 10 calculates an angle $\theta_{A'}$ made by the points plotting the target color T and the points plotting one of the colors detected in step S3, and an angle $\theta_{B'}$ made by the points plotting the target color T and the points plotting the other color. The controller 10 then calculates the difference ratio $\theta_{B'}/\theta_{A'}$ which is the ratio of the differences between respective colors and the target color T (hue differences).

The controller 10 compares the calculated difference ratio $\theta_{B'}/\theta_{A'}$ with the difference ratio $\theta_B/\theta_A$ of the reference data, calculates the color correction amount to satisfy $\theta_{B'}/\theta_{A'}=\theta_B/\theta_A$, and stores (rewrites) the calculated color correction amount in the RAM 102.

The target color T is, for example, a value which was set in advance as the mixed color (blue in the present embodiment) of the two colors forming the pattern image 30. The target color T may be a value which was set with a color standard or may be a value which was set originally.

For example, in the example of M (Mgn) and C (Cyn) shown in FIGS. 6A and 6B, the relationship of $(\theta_{B'}/\theta_{A'})/(\theta_B/\theta_A)=1.1$ indicates $\theta_{B'}/\theta_{A'}>\theta_B/\theta_A$. Thus, the amount of M is decreased or the amount of C is increased. Thus, the color correction of increasing the amount of M or decreasing the amount of C is necessary to satisfy $\theta_{B'}/\theta_{A'}=\theta_B/\theta_A$. When the color correction is performed on the image data, the correction rate greater than 1 may lead to the value which cannot be reproduced. Thus, the controller 10 calculates the color correction amount used to multiply the amount of C which is increased. To be specific, $1/1.1\approx0.91$ ($\approx$ indicates nearly equal) is calculated as the color correction amount of C.

The controller 10 then determines whether or not the color correction is necessary (step S7).

For example, when there is a color for which the color correction amount stored in the RAM 102 is other than 1, the controller 10 determines that the color correction is necessary.

If the controller 10 determines that the color correction is not necessary (step S7; NO), the controller 10 proceeds to step S9.

If the controller 10 determines that the color correction is necessary (step S7; YES), the controller 10 multiplies the next image data in the job by the color correction amount calculated in step S6 to perform the color correction (step S8), and proceeds to step S9.

On the other hand, in step S1, if the controller 10 determines that the predetermined timing has not come (step S1; NO), the controller 10 proceeds to step S7, refers to the RAM 102, and determines whether or not the color correction is necessary. If the controller 10 determines that the correction is not necessary (step S7; NO), the controller 10 proceeds to step S9. If the controller 10 determines that the color correction is necessary (step S7; YES), the controller 10 corrects the next image data in the job (step S8), and proceeds to step S9.

In step S9, the controller 10 determines whether or not the job is finished (step S9). If the controller 10 determines that the job is not finished (step S9; NO), the controller 10 returns to step S1. If the controller 10 determines that the job is finished (step S9; YES), the controller 10 ends the color correction processing.

When the job is finished, the controller 10 deletes the reference data stored in the storage 11.

As described above, the image forming apparatus 1 includes an intermediate transfer body 174 that is colorless and transparent, and has a transparency, and color information detectors 176 and 177 that are arranged on the front and back surface sides of the intermediate transfer body 174 and detect color information about the pattern image 30 including two layers formed on the intermediate transfer body 174 by two image formers of the image forming section 17. The controller 10 calculates a color correction amount of an image formed by the above two image formers on the basis of the detection results by the color information detectors 176 and 177.

Accordingly, since it is possible to detect the color information on each color of the pattern image 30 including the two layers in which the toner of the colors forming the secondary color is not mixed with each other, the color information on each color can be detected accurately, and the secondary color can be effectively corrected. Furthermore, since it is not necessary to form the pattern image 30 on the sheet or fix the pattern image 30 to the sheet, the color information on each color can be detected without wasting sheets or reducing the productivity.

By the color information detectors 176 and 177 arranged on the front and back surface sides of the intermediate transfer body 174 being arranged at such positions that spot faces of light emitted from the respective light sources do not overlap with each other, for example, it is possible to detect the color information while avoiding the influence by the emitted light from the color information detector on the opposite side.

By the color information detector 176 arranged on the front surface side of the intermediate transfer body 174 detecting the color information on the color for which the image was formed on the downstream side of the image creating process among the colors forming the pattern image 30 and by the color information detector 177 arranged on the back surface side of the intermediate transfer body 174 detecting the color information on the color for which the image was formed on the upstream side of the image creating process among the colors forming the pattern image including two layers, it is possible to accurately detect the color information on each of the colors forming the pattern image 30 including the two layers.

When a predetermined timing has come, for example, the controller 10 controls two image formers to form the pattern image 30 including two layers on the intermediate transfer body 174, and controls the color information detectors 176 and 177 to detect the color information on the two colors on the front and back surface sides of the intermediate transfer body 174. The controller 10 then calculates the color correction amount on the basis of the comparison between the reference data which was detected at a reference timing and the color information on two colors which was detected at a predetermined timing. For example, the controller 10 calculates the color correction amount such that the difference rate of the differences between the color information on the respective two colors of the reference data and the target color which was determined in advance is same as the difference rate of the differences between the color information on the respective two colors detected at a predetermined timing and the target color determined in advance. Accordingly, it is possible to stably correct the change in color from the reference timing.

By setting the predetermined timing to a timing when the number of printed sheets, the operation time, the operation distance or the environment change amount in the image forming apparatus 1 becomes a threshold or more, for example, it is possible to calculate the color correction amount periodically during printing or when the environment changes.

The description of the above embodiment is merely an example of a preferred image forming apparatus according to the present invention, and the present invention is not limited to this.

For example, though the image forming apparatus has been described as performing image formation on sheets in the above embodiment, the image formation may be performed on other recording mediums such as a seal, a fabric, and a film material.

Though the above embodiment has been described for an example of applying the present invention to an electrophotographic type image forming apparatus, the present invention may be applied to image forming apparatuses of other printing methods such as an inkjet printer.

In the above embodiment, the color correction amount is calculated by using the hue information of the color information detected by the color information detectors 176 and 177. However, saturation information and brightness information may be used. The color correction amounts may be calculated by respectively using hue information, saturation information and brightness information, and the final color correction amount may be calculated by obtaining the weighted average of the calculated color correction amounts.

In the above embodiment, the reference data is the color information obtained by detecting, with the color information detectors 176 and 177, the pattern image 30 including two layers which was formed on the intermediate transfer body 174 by two image formers in advance at a reference timing. However, there may be used reference color information which was stored in the storage 11 in advance as the reference data.

The above embodiment discloses an example of using a semiconductor memory or an HDD as the computer readable medium storing the program for executing each processing. However, the present invention is not limited to the above example. A portable recording medium such as a CD-ROM can be applied as other computer readable medium. A carrier wave is also applied as the medium to provide program data through the communication lines.

The other detailed configurations and detailed operations of the of the image forming apparatus can be suitably changed without departing from the scope of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a belt on which images of a plurality of colors are formed to be laid on each other by a plurality of image formers that form the images of color components different from each other, the belt being colorless and transparent and having a transparency;

a plurality of color information detectors that are arranged on a front surface side and a back surface side of the belt, and detect, from the front surface side and the back surface side, color information about a pattern image including two layers formed on the belt by two image formers among the plurality of image formers; and a hardware processor that calculates a color correction amount of an image formed by the two image formers based on detection results by the color information detectors;

wherein the color information detectors arranged on the front surface side and the back surface side of the belt include respective light sources and respective light receivers, and the color information detectors are arranged at such positions that spot faces of light emitted from the respective light sources do not overlap with each other.

2. The image forming apparatus according to claim 1, wherein, among the color information detectors, the color information detector arranged on the front surface side of the belt detects color information on a color for which an image is formed on a downstream side of an image creating process among colors forming the pattern image including the two layers, and the color information detector arranged on the back surface side of the belt detects color information on a color for which an image is formed on an upstream side of the image creating process among the colors forming the pattern image including the two layers.

3. The image forming apparatus according to claim 1, wherein the color information detectors are color sensors.

4. The image forming apparatus according to claim 1, wherein the hardware processor corrects image data of a job based on the calculated color correction amount.

5. An image forming apparatus comprising:

a belt on which images of a plurality of colors are formed to be laid on each other by a plurality of image formers that form the images of color components different from each other, the belt being colorless and transparent and having a transparency;

a plurality of color information detectors that are arranged on a front surface side and a back surface side of the belt, and detect, from the front surface side and the back surface side, color information about a pattern image including two layers formed on the belt by two image formers among the plurality of image formers;

a hardware processor that calculates a color correction amount of an image formed by the two image formers based on detection results by the color information detectors; and a storage in which reference color information on two colors forming the pattern image including the two layers is stored, wherein when a predetermined timing comes, the hardware processor controls the two image formers to form the pattern image including the two layers on the belt and controls the color information detectors to detect the color information on the two colors on the front surface side and the back surface side of the belt, and the hardware processor calculates the color correction amount based on comparison between the reference color information on the two colors stored in the storage and the detected color information on the two colors.

6. The image forming apparatus according to claim 5, wherein the reference color information on the two colors is color information obtained by detecting, with the color information detectors, a pattern image including two layers that are formed on the belt by the two image formers in advance at a reference timing.

7. The image forming apparatus according to claim 5, wherein the hardware processor calculates the color correction amount such that a difference rate of differences between the reference color information on the respective two colors and a target color determined in advance is the same as a difference rate of differences between the detected color information on the respective two colors and the target color determined in advance.

8. The image forming apparatus according to claim 5, wherein the hardware processor calculates the color correction amount by using at least one of hue information, saturation information and brightness information of the reference color information on the two colors and the detected color information on the two colors.

9. The image forming apparatus according to claim 5, wherein the predetermined timing is a timing when a number of printed sheets, an operation time, an operation distance or an environment change amount in the image forming apparatus becomes equal to or more than a threshold that is determined in advance.

* * * * *